US007017510B1

(12) United States Patent
Nair

(10) Patent No.: US 7,017,510 B1
(45) Date of Patent: Mar. 28, 2006

(54) ARTIFICIAL WIND PRODUCING FLAG POLE ASSEMBLY

(76) Inventor: Baskaran C. Nair, 8806 Bryce Canyon Ct., Spring, TX (US) 77379

( * ) Notice: Subject to any disclaimer, the term of this patent is extended or adjusted under 35 U.S.C. 154(b) by 0 days.

(21) Appl. No.: 10/808,080

(22) Filed: Mar. 24, 2004

Related U.S. Application Data

(60) Provisional application No. 60/458,134, filed on Mar. 27, 2003.

(51) Int. Cl.
*G09F 17/00* (2006.01)

(52) U.S. Cl. ..... 116/173; 40/218

(58) Field of Classification Search ..... 116/173, 116/174, 175; 40/218
See application file for complete search history.

(56) References Cited

U.S. PATENT DOCUMENTS

| | | | | | |
|---|---|---|---|---|---|
| 1,102,270 | A | * | 7/1914 | Howard | 40/218 |
| 1,660,341 | A | | 2/1928 | Lapworth | 40/218 |
| 1,725,250 | A | | 8/1929 | Burgess | 40/218 |
| 2,270,753 | A | | 1/1942 | Fikes | 40/218 |
| 2,377,219 | A | * | 5/1945 | Ellis | 116/173 |
| 2,870,559 | A | * | 1/1959 | Shaughnessy | 40/614 |
| 3,477,161 | A | * | 11/1969 | Drexler | 40/218 |
| 3,798,816 | A | * | 3/1974 | Flaherty | 40/218 |
| 5,398,638 | A | * | 3/1995 | Bonk | 116/173 |
| 5,427,050 | A | | 6/1995 | Horn | 116/273 |
| 5,572,835 | A | * | 11/1996 | Atkins et al. | 52/111 |
| 5,943,980 | A | * | 8/1999 | Huang | 116/174 |
| 5,975,009 | A | * | 11/1999 | Nihra et al. | 116/173 |

FOREIGN PATENT DOCUMENTS

| | | | | |
|---|---|---|---|---|
| FR | 2647579 | A1 | * | 11/1990 |
| JP | 04218090 | A | * | 8/1992 |
| JP | 10049090 | A | * | 2/1998 |
| JP | 2000276086 | A | * | 10/2000 |
| JP | 2000298444 | A | * | 10/2000 |

* cited by examiner

*Primary Examiner*—R. Alexander Smith

(57) ABSTRACT

An artificial wind producing flag pole assembly for providing airflow in windless conditions to display a flag in an unfurled position as if a steady wind was present. The artificial wind producing flag pole assembly includes a flagpole having a hollow interior. An air blower is coupled to a base of the flagpole for producing airflow into and through the hollow interior of the flagpole. A top portion of the flagpole has a plurality of holes to direct the airflow from the interior of the flagpole out towards a flag connected to the flagpole. The airflow coming out of the holes holds the flag in an unfurled position.

1 Claim, 2 Drawing Sheets

ARTIFICIAL WIND PRODUCING FLAG POLE ASSEMBLY

CROSS REFERENCE TO RELATED APPLICATION

This application claims the benefit of U.S. Provisional Application No. 60/458,134, filed Mar. 27, 2003.

BACKGROUND OF THE INVENTION

1. Field of the Invention

The present invention relates to flag poles and more particularly pertains to a new artificial wind producing flag pole assembly for providing airflow in windless conditions to display a flag in an unfurled position as if a steady wind was present.

2. Description of the Prior Art

The use of flag poles is known in the prior art. U.S. Pat. No. 2,270,753 describes a device for directing air over the surface of a flag to keep the flag unfurled. Another type of flag pole is U.S. Pat. No. 1,725,250 having a fan coupled to a motor and positioned in the base of a flagpole to blow air through the flagpole to keep the flag in an unfurled state. U.S. Pat. No. 1,660,341 has a fan coupled to a hollow flagpole with ports extending into the flagpole to allow air to escape to keep a flag unfurled. U.S. Pat. No. 5,427,050 having an air blower positioned in the base of the flagpole that blows air out of the base and is directed towards the flag to keep the flag unfurled.

While these devices fulfill their respective, particular objectives and requirements, the need remains for a device that has certain improved features to allow the air blower to counter to force exerted on the flag pole when the flag is unfurled.

SUMMARY OF THE INVENTION

The present invention meets the needs presented above by providing the blower assembly coupled to the side of the base member opposite the clip members so that the flag extends away from the blower assembly to allow the weight of the blower assembly balance the force applied to the flagpole when the flag is unfurled.

Still yet another advantage of the present invention is to provide a new artificial wind producing flag pole assembly that has a planar bottom face of the base member positioned below the flagpole to resisting tipping of the flagpole from any forced applied to the flagpole when the flag is unfurled.

To this end, the present invention generally comprises a flagpole having a hollow interior. An air blower is coupled to a base of the flagpole for producing airflow into and through the hollow interior of the flagpole. A top portion of the flagpole has a plurality of holes to direct the airflow from the interior of the flagpole out towards a flag connected to the flagpole. The airflow coming out of the holes holds the flag in an unfurled position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
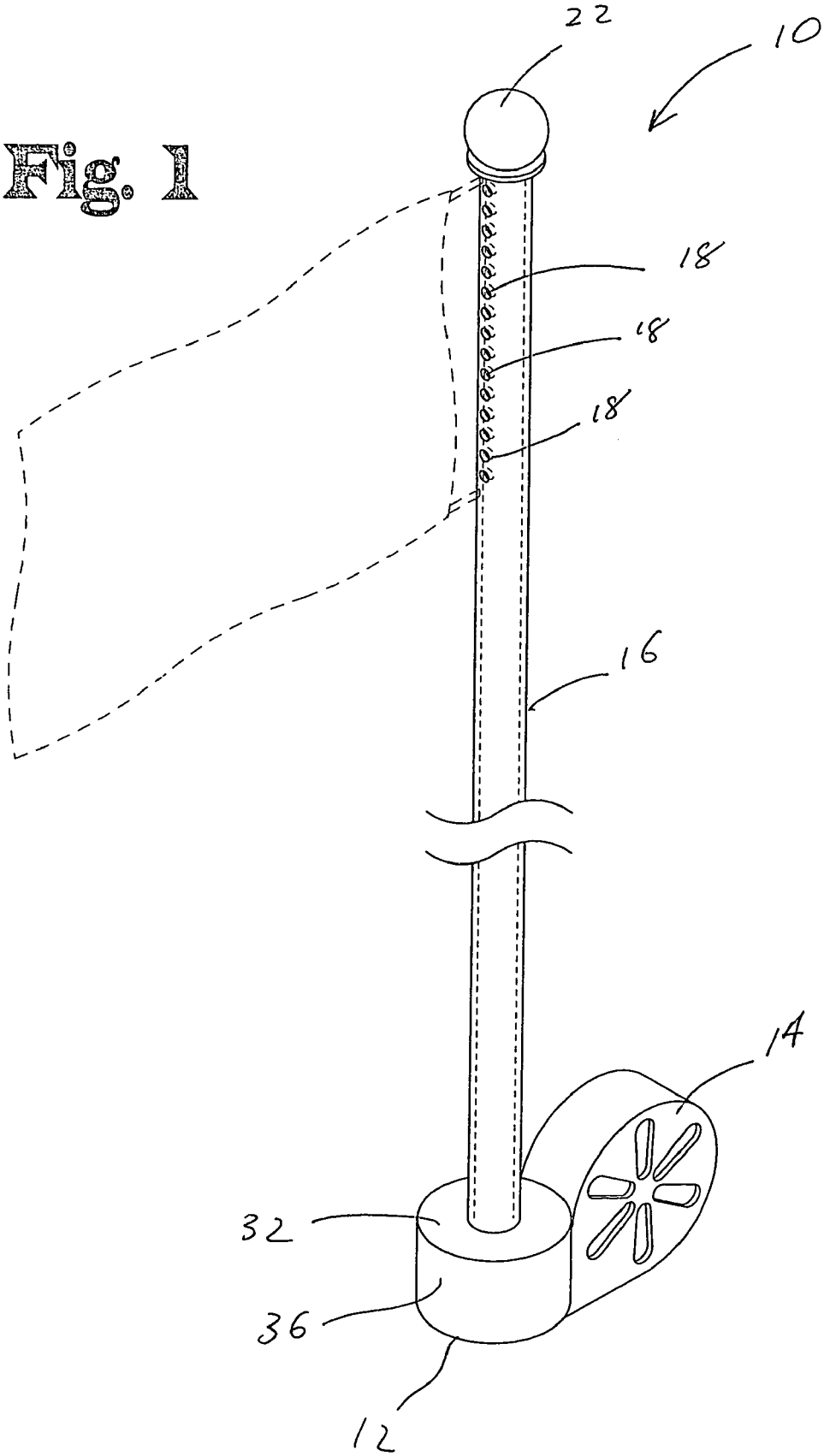
FIG. 1 is a perspective view of a new artificial wind producing flag pole assembly according to the present invention.
Figure 2:
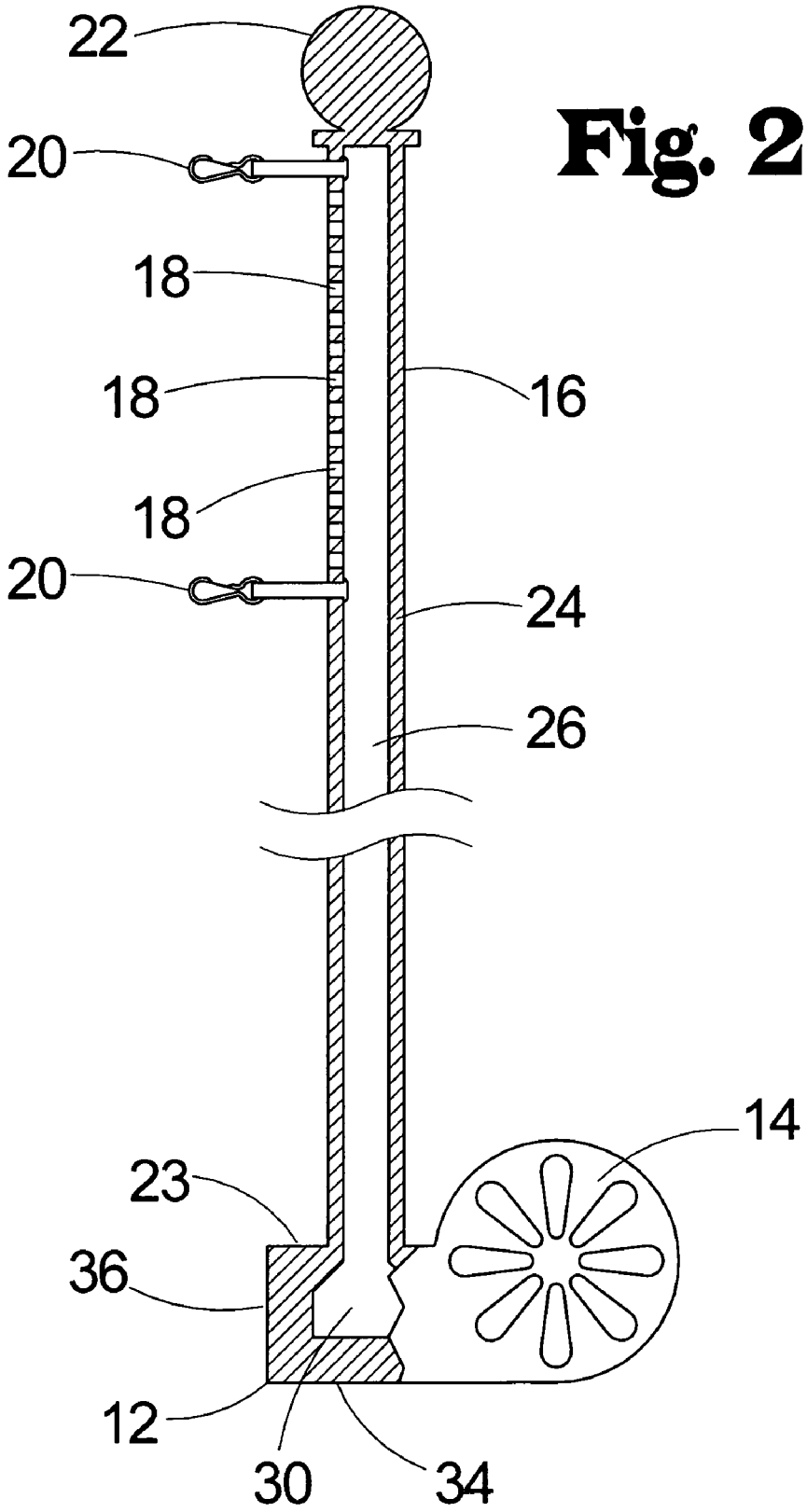
FIG. 2 is a cross-sectional view of the present invention taken along line 2—2 of FIG. 1.

With reference now to the drawings, and in particular to FIGS. 1 and 2 thereof, a new artificial wind producing flag pole assembly embodying the principles and concepts of the present invention and generally designated by the reference numeral 10 will be described.

As best illustrated in FIGS. 1 and 2, the artificial wind producing flag pole assembly 10 generally comprises a base member 12 being designed for being positioned on a support surface.

A blower assembly 14 is coupled to the base member 12 whereby the blower assembly 14 is in fluid communication with the base member 12. The blower assembly 14 is designed for blowing air into the base member 12.

A flagpole 16 is coupled to the base member 12 whereby the flagpole 16 is in fluid communication with the base member 12. The flagpole 16 is positioned opposite the blower assembly 14 whereby the blower assembly 14 is designed for blowing air through the base member 12 into the flagpole 16. The flagpole 16 comprising a plurality of exhaust apertures 18 extending into the flagpole 16 whereby each of the exhaust apertures 18 allow air blown into the flagpole 16 to be exhausted. The flagpole 16 is designed for receiving the flag whereby the flag is positioned proximate the exhaust apertures 18 to allow the air exhausted through the exhaust apertures 18 to flow over the flag and maintain the flag in the unfurled position.

A plurality of clip members 20 are coupled to the flagpole 16. Each of the clip members 20 is designed for being selectively coupled to the flag whereby the clip members 20 are for coupling the flag to the flagpole 16.

The clip members 20 are positioned in a space relationship proximate a top end 22 of the flag pole. The clip members 20 are designed for being selectively coupled to a base edge of the flag whereby the clip members 20 maintain the base edge of the flag in a substantially vertical position and substantially aligned with a longitudinal axis of the flagpole 16 when the clip members 20 are coupled to the base edge of the flag.

The exhaust apertures 18 of the flagpole 16 are aligned with the clip members 20 whereby the exhaust apertures 18 are positioned between the clip members 20. The exhaust apertures 18 are designed for being aligned with the base edge of the flag whereby the exhaust apertures 18 exhaust the air over the base edge and along the sides of the flag to unfurl the flag when the flag is coupled to the clip members 20.

The clip members 20 are positioned opposite the blower assembly 14. The clip members 20 are designed for permitting the flag to extend outwardly from the flagpole 16 in a direction opposite the blower assembly 14 whereby a weight of the blower assembly 14 facilitates stability of the flagpole 16 by balancing a force applied to the flagpole 16 by the flag when the flag is unfurled.

The flagpole 16 comprises a perimeter wall 24. The perimeter wall 24 defines a venting bore 26 extending along a portion of a length of the flagpole 16. Each of the exhaust apertures 18 extends through the perimeter wall 24 whereby each of the exhaust apertures 18 is in fluid communication with the venting bore 26. The venting bore 26 comprises an open end 28 in fluid communication with the base member 12 whereby air supplied by the blower assembly 14 enters the venting bore 26 through the open end 28 and is exhausted from the venting bore 26 through the exhaust apertures 18.

The base member 12 comprises a transfer bore 30. The transfer bore 30 extends through the base member 12 whereby transfer bore 30 is in fluid communication with the blower assembly 14 and the open end 28 of the venting bore 26 of the flagpole 16. The transfer bore 30 of the base member 12 is designed for permitting air flow produced by the blower assembly 14 to be directing into the venting bore 26 of the flagpole 16.

The base member 12 comprises an upper face 32, a bottom face 34 and a perimeter face 36. The perimeter face 36 extends between the upper face 32 and the bottom face 34. The blower assembly 14 is coupled to the perimeter face 36 of the base member 12. The flagpole 16 is coupled to the upper face 32 of the base member 12 whereby the flagpole 16 extends upwardly from the base member 12. The bottom face 34 is designed for being positioned on the support surface. The bottom face 34 of the base member 12 is substantially planar whereby the bottom face 34 resists tipping of the base member 12 and the flagpole 16 when the base member 12 is positioned on the support surface and the flag is unfurled from the flagpole 16.

In use, the user couples the flag to the clip members 20. The blower assembly 14 is actuated to blow air into the flagpole 16. As the air is exhausted out of the exhaust apertures 18 of the flagpole 16 the air passes over the flag and unfurls the flag as if the flag was in a steady wind.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An artificial wind producing flag pole assembly for maintaining a flag in an unfurled position, the artificial wind producing flag pole assembly comprising:

a base member being adapted for being positioned on a support surface, said base member being substantially hollow and substantially cylindrical in shape;

a blower assembly being coupled to said base member such that said blower assembly is in fluid communication with said base member, said blower assembly being adapted for blowing air into said base member;

a flagpole being coupled to said base member such that said flagpole is in fluid communication with said base member, said flagpole being positioned opposite said blower assembly such that said blower assembly is adapted for blowing air through said base member into said flagpole, said flagpole comprising a plurality of exhaust apertures extending into said flagpole such that each of said exhaust apertures allow air blown into said flagpole to be exhausted, said flagpole being adapted for receiving the flag such that the flag is positioned proximate the exhaust apertures to allow the air exhausted through said exhaust apertures to flow over the flag and maintain the flag in the unfurled position;

a plurality of clip members being coupled to said flagpole, each of said clip members being adapted for being selectively coupled to the flag such that said clip members are for coupling the flag to said flagpole;

said clip members being positioned in a space relationship proximate a top end of said flag pole, said clip members are adapted for being selectively coupled to a base edge of the flag such that said clip members maintain the base edge of the flag in a substantially vertical position and substantially aligned with a longitudinal axis of said flagpole when said clip members are coupled to the base edge of the flag;

said exhaust apertures of said flagpole being aligned with said clip members such that said exhaust apertures are positioned between said clip members, said exhaust apertures are adapted for being aligned with the base edge of the flag such that said exhaust apertures exhaust the air over the base edge and along the sides of the flag to unfurl the flag when the flag is coupled to said clip members;

said clip members being positioned opposite said blower assembly, said clip members being adapted for permitting the flag to extend outwardly from said flagpole in a direction opposite said blower assembly such that a weight of said blower assembly facilitates stability of said flagpole by balancing a force applied to said flagpole by the flag when the flag is unfurled;

said flagpole comprising a perimeter wall, said perimeter wall defining a venting bore extending along a portion of a length of said flagpole, each of said exhaust apertures extending through said perimeter wall such that each of said exhaust apertures is in fluid communication with said venting bore, said venting bore comprising an open end in fluid communication with said base member such that air supplied by said blower assembly enters said venting bore through said open end and is exhausted from said venting bore through said exhaust apertures;

said base member comprising a transfer bore, said transfer bore extending through said base member such that transfer bore is in fluid communication with said blower assembly and said open end of said venting bore of said flagpole, said transfer bore of said base member being adapted for permitting air flow produced by said blower assembly to be directing into said venting bore of said flagpole; and said base member comprising a substantially circular upper face, a substantially circular bottom face and a substantially cylindrical perimeter face, said upper face being substantially planar and said bottom face being substantially planar, said perimeter face extending between said upper face and said bottom face, said blower assembly being coupled to said perimeter face of said base member, said flagpole being coupled to said upper face of said base member such that said flagpole extends upwardly from said base member, said bottom face being adapted for being positioned on the support surface, said bottom face of said base member being substantially planar such that said bottom face resists tipping of said base member and said flagpole when said base member is positioned on the support surface and the flag is unfurled from said flagpole;

wherein said bottom face of said base member being located at a lowermost position on said flag pole assembly such that said flag pole assembly rests on said bottom face;

wherein said blower assembly is positioned laterally outward from said base member and is rigidly connected to the base member in a manner such that said blower assembly rests on a ground surface when said base member rests on the ground surface;

wherein said blower assembly having an interior with an outlet, the outlet of said blower assembly connected to a portion of said perimeter face of said base member such that said blower assembly blows air into said base member through said perimeter face;

wherein said plurality of exhaust apertures are positioned on an opposite side of said flagpole from a mounting location of said blower assembly on said base member.

* * * * *